US007838788B2

(12) United States Patent
Kommert et al.

(10) Patent No.: US 7,838,788 B2
(45) Date of Patent: Nov. 23, 2010

(54) ELECTRICAL SWITCHING DEVICE HAVING AT LEAST ONE CONTACT POINT

(75) Inventors: Richard Kommert, Heidelberg (DE); Rüdiger Schweitzer, Neulußheim (DE); Anke Dietzel, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 505 days.

(21) Appl. No.: 11/857,762

(22) Filed: Sep. 19, 2007

(65) Prior Publication Data

US 2008/0067048 A1 Mar. 20, 2008

(30) Foreign Application Priority Data

Sep. 20, 2006 (DE) ..... 10 2006 044 055

(51) Int. Cl.
*H01H 21/00* (2006.01)

(52) U.S. Cl. ..... 200/553; 200/558; 200/339

(58) Field of Classification Search ..... 200/6 R–6 BB, 200/16 R–16 C, 553, 559, 339
See application file for complete search history.

(56) References Cited

U.S. PATENT DOCUMENTS 2,930,865 A * 3/1960 Roeser ..... 200/428
3,591,747 A * 7/1971 Dennison ..... 200/557
3,598,943 A * 8/1971 Barrett ..... 200/437
5,158,172 A * 10/1992 Roeser et al. ..... 200/553
6,459,060 B1 * 10/2002 Bartok ..... 200/553
6,576,855 B2 * 6/2003 Levendis et al. ..... 200/339
6,596,956 B1 * 7/2003 Czarnecki ..... 200/552
6,911,612 B2 * 6/2005 Seki ..... 200/339
6,930,269 B1 * 8/2005 Lee et al. ..... 200/553
6,974,918 B2 * 12/2005 Blossfeld ..... 200/5 R
7,026,565 B1 * 4/2006 Lee ..... 200/339
7,560,656 B2 * 7/2009 Okatani et al. ..... 200/559

* cited by examiner

*Primary Examiner*—Michael A Friedhofer
(74) *Attorney, Agent, or Firm*—Buchanan Ingersoll & Rooney PC

(57) ABSTRACT

The disclosure relates to an electrical switching device, in particular a thermal relay having at least one contact point in which, in a first position, the contact point is open and, in a second position, the contact point is closed, having a swivelling contact carrier on which the at least one moving contact piece is held and having an actuator for driving the contact carrier. The actuator is a swivel element, which can rotate about a first axis of rotation, said swivel element being made up of two partial elements, which can be slid in mutually opposing directions and are pushed apart by spring force, of which the first partial element is rotatably mounted and the second partial element acts together with the contact carrier at its free end.

24 Claims, 1 Drawing Sheet

ELECTRICAL SWITCHING DEVICE HAVING AT LEAST ONE CONTACT POINT

RELATED APPLICATIONS

This application claims priority under 35 U.S.C. §119 to German Application 10 2006 044 055.2 filed in Germany on Sep. 20, 2006, the entire contents of which are hereby incorporated by reference in their entireties.

TECHNICAL FIELD

An electrical switching device having at least one contact point is disclosed in which, in a first position, the contact point is open and, in a second position, the contact point is closed, having a swivelling contact carrier on which the at least one moving contact piece is held and having an actuator for driving the contact carrier.

Accordingly, the invention relates to all switches with two switching states, in particular thermal relays, microswitches and auxiliary switches.

BACKGROUND INFORMATION

In a known thermal overcurrent relay, a thermal bimetal is provided for each phase, the free bent-out ends of which act on a slider by means of which a double-arm lever is actuated, which acts via a further slider on a leaf spring, which is clamped at one end, to the free end of which an arm of a U-shaped snap-action spring is linked, the other arm of which acts on a contact leaf spring. At its free end, the contact leaf spring has a moving contact piece, which, together with a fixed contact piece, forms a contact point. In a first position, the contact point is closed and when the second slider is moved, the leaf spring is bent until the linking point of the snap-action spring reaches its dead point position; when the second slider is moved further, the snap-action spring snaps over and opens the contact point.

Similar arrangements can be found in a large number of variants in other snap-action switch elements.

In these known arrangements, a reduction in the contact force and/or a relative movement in the contact point usually occurs before the contact actually opens. Furthermore, it is usually possible and also necessary to adjust the snap-action device.

SUMMARY

The object of the disclosure is to create an electrical switching device, in particular a thermal overcurrent relay, in which a slow contact movement is avoided, when actuated by means of the thermal bimetals as well, even at low overcurrents.

According to the disclosure, the actuator is a swivel element, which can rotate about a first axis of rotation, said swivel element being made up of two partial elements, which can be slid in mutually opposing directions and are pushed apart by spring force, of which the first partial element is rotatably mounted and the second partial element acts together with the contact carrier at its free end.

A toggle switch having a contact beam as contact carrier for a moving contact piece has been disclosed in DE 43 24 206 C2. It has a switching piece, which is actuated by a plunger. On the switching piece is a switching roller, which slides on a wedge piece, which, at one end of the contact beam, is fixed to the moving contact piece, which is mounted at its other end in a knife-edge bearing. By actuating the switching piece, the switching roller slides on the wedge piece and in doing so moves the wedge piece out of a first stable position via a dead point position into a second stable position and back again.

A similar arrangement of a switch, in this case a steering column switch, has been disclosed in DE 36 26 241.

Changes in the contact force during the switchover process are not really to be expected with such switching devices as described in DE 43 24 206 or DE 36 26 241. However, switching arrangements as shown in these two publications cannot be used, particularly for thermal relays and the like, as both a normally-closed and a normally-open contact, which must be galvanically isolated from one another, are usually required here. This cannot be realized with known devices according to the prior art, as here the contact beam is galvanically connected to the contact pieces.

At the same time, the two partial elements can be guided telescopically inside one another.

According to a particularly advantageous embodiment of the disclosure, the axis of rotation of the actuator and of the contact carrier can lie on a line, which in a dead point position runs perpendicular to the longitudinal extension of the contact carrier, so that when the actuator is swivelled out of a first stable position via the dead point position in which the actuator is aligned with the line, it is moved into a second stable position and back again.

At the same time, the contact carrier can be constructed as a single-arm or as a double-arm contact carrier.

The mode of operation is then such that, in a switch-on position, for example, the centre axis of the actuator runs at an acute angle to the longitudinal extension of the contact carrier. When the actuator is swivelled, then the tip or free actuating end of the actuator moves into the dead point position in which the longitudinal extension of the actuator is in line with the line connecting the axis of rotation of the contact carrier and of the actuator; as soon as the actuator is swivelled further, this moves into its second stable position in which the at least one contact point is open, wherein the spring between the partial elements relaxes.

This mode of operation comes about when the contact carrier is a single-arm or double-arm lever, on each of the free ends of which at least one contact point is arranged. In this case the one contact point would be closed and the other open, and, when the actuator is swivelled, the other contact point would be closed and the first contact point would be opened.

In a particularly advantageous manner, the at least one contact point is constructed as a double contact point, which has fixed contacts, which can be closed or opened by means of a contact bridge with two moving contact pieces, which is mounted on the contact carrier.

In an advantageous embodiment of the disclosure, the free end of the actuator can be provided with a roller, as a result of which friction forces are reduced.

A further advantageous embodiment of the disclosure can be effected in that a roof-shaped elevation or a roof-shaped projection is provided on the contact carrier so that an exactly defined changeover point is produced here. In doing so, the peak of the elevation lies on the line connecting the pivot point of the actuator and the pivot point of the contact carrier.

Pivot shafts or pivot pins can be provided as axes of rotation; it is, of course, also possible to produce an axis of rotation by providing a knife-edge bearing.

In an advantageous embodiment of the disclosure, the contact carrier is made from electrically non-conducting material, which, if necessary, has a metal plate only on the sliding surface or rolling surface on which the actuator slides during the switching operations.

In a further advantageous embodiment of the disclosure, the contact carrier is made from electrically non-conducting material and is reinforced by means of a metal plate in the area of the knife-edge bearing, which forms the axis of rotation of the contact carrier. This increases the life of the knife-edge bearing.

Further advantageous embodiments and improvements of the disclosure can be seen from the further subclaims.

BRIEF DESCRIPTION OF THE DRAWINGS

The disclosure, as well as further embodiments and improvements and further advantages, will be explained and described in more detail with reference to the drawing in which some exemplary embodiments of the invention are shown.

DETAILED DESCRIPTION

Figure 1:
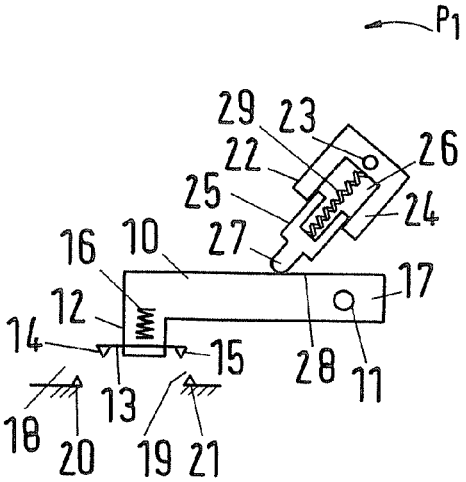
FIG. 1 shows a single-arm contact carrier with actuator.

FIG. 1 shows a switching device having a single-arm contact carrier 10, which is rotatably mounted on an axis of rotation 11 in the region of its one end. An L-shaped projection 12 is provided on the other end of the contact carrier 10 in which projection a contact bridge 13 with two moving contact pieces 14 and 15 is mounted, a contact compression spring 16 being provided. The design of the mounting of the contact bridge 13 within the projection 12 is known in itself so that no further comments will be made in this regard.

The contact carrier 10 projects beyond the axis of rotation with an extension 17 in the opposite direction to the projection.

An actuator 22, which is rotatably mounted about an axis of rotation 23, is provided in order to actuate the contact carrier and therefore to open or close the contact points 18 and 19, which are formed by the moving contact pieces 14 and 15 and fixed contact pieces 20, 21. The actuator 22 has a first partial element 24, and the axis of rotation 23 is provided on this first partial element 24. Furthermore, it has a second partial element 25, which engages in an accommodating opening 26 of the first partial element 24; the free end of the second partial element 25 is provided with a pin 27, which slides on the surface 28 of the contact carrier, which is on the opposite side from the contact points. A compression spring 29 is provided between the two partial elements 24 and 25.

The centre axes of the axis of rotation 11 and the axis of rotation 23 lie on a line running perpendicular to the top surface 28.

When the actuator 22 is now swivelled out of the position shown in FIG. 1 in the direction of the arrow $P_1$, then the free end of the pin 27 slides along the surface 28 or edge 28 of the contact carrier 10, whereby the second partial element 25 slides into the interior of the accommodating opening 26, as a result of which the compression spring 29 is compressed. As soon as the pin 27 slides out over the line connecting the axis of rotation 23 and the axis of rotation 11, the compression spring 29 relaxes and in doing so presses on the extension 17, as a result of which the contact carrier is suddenly swivelled about its axis 11 in the opposite direction to the arrow $P_1$, i.e. in the clockwise direction.

The length of the extension must then he such that the pin 27 of the actuator also remains in the area of the top surface 28 in the position in which the actuator finds itself after swivelling.

Figure 2:
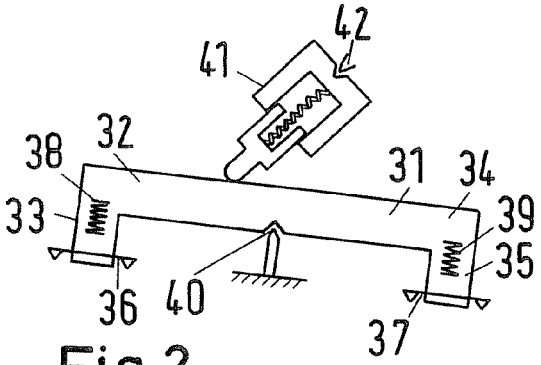
FIG. 2 to 5 show different embodiments of a double-arm contact carrier in a first switching position in each case.

FIG. 2 shows a further embodiment of the disclosure. The contact carrier 31 is constructed as a double-arm carrier, the first arm 32 having an L-shaped extension 33, and the second arm 34 an L-shaped extension 35, so that a U-shape is formed with the two L-shaped moulded-on sections 33 and 35. A contact bridge 36, 37 is mounted on each of the ends of the extensions or projections 33, 35, a contact compression spring 38 and 39 being provided in each case. A knife-edge bearing 40, which is located on the side of the contact carrier opposite to the actuator 41, is provided as an axis of rotation for the contact carrier 31. The actuator 41 and the knife-edge bearing 40 are respectively provided on opposite sides of the contact carrier 31. At the same time, the actuator 41 is also rotatably mounted by means of a knife-edge bearing 42; the mode of operation as such is the same as in the embodiment according to FIG. 1.

Figure 3:
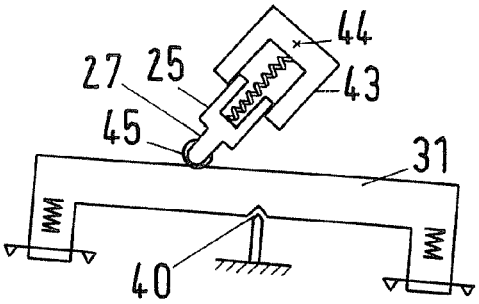

In the embodiment according to FIG. 3, the contact carrier 31 is mounted on the knife-edge bearing 40; the actuator 43 is rotatably mounted on an axis of rotation 44, which corresponds to the axis of rotation 23. A roller 45, which rolls on the contact carrier 31, is provided on the free end of the partial element 25, i.e. on the pin 27; the friction force to be applied is reduced in comparison with the embodiments according to FIGS. 1 and 2 in which the pin 27 slides.

Figure 5:
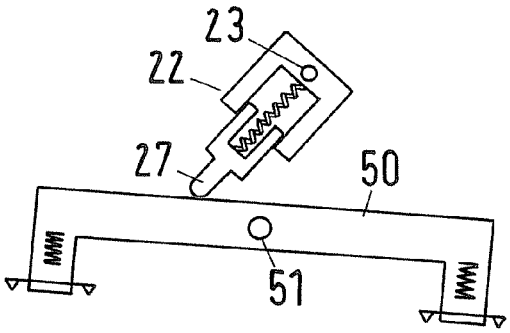

The embodiment according to FIG. 5 shows a contact carrier 50, which is constructed in a similar manner to the contact carrier 31; the difference consists only in the fact that the contact carrier 50 is rotatably mounted on a centre pivot shaft 51.

Figure 4:
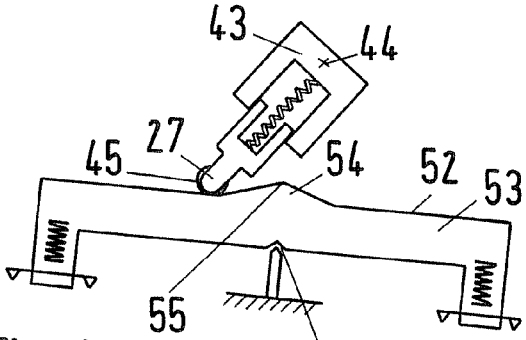

In the embodiment according to FIG. 4, a roof-shaped projection 54, the peak 55 of which is located on the line connecting the axis of rotation 44 of the actuator 43 and the knife-edge bearing 40, is provided on the top side 52 of a contact carrier 53 facing the actuator. In the embodiment according to FIG. 4, the roller 45 is provided at the end of the pin 27; this roller slides on the one side of the roof-shaped extension 54 and, as soon as the roller 45 has passed the roof edge 55, the contact carrier 53 flips over in the clockwise direction so that the contact bridge shown on the left in the drawing is opened and the contact bridge shown on the right in the drawing is suddenly closed.

In the embodiments according to FIGS. 2, 3, 4, the contact carrier 31, 53 in the area of the knife-edge bearing 40, which forms the axis of rotation of the contact carrier 31, 53, can be reinforced by means of a metal plate (not shown). The contact carrier 31, 53 can then also be made from a softer and therefore cheaper plastic material. The wear to be expected in the area of the knife-edge bearing 40 with such materials is counteracted by reinforcing only this small local area by means of a metal plate. The injection of a metal plate into a plastic part is a known manufacturing step which is convenient to carry out.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

10 Contact carrier
11 Axis of rotation
12 Projection
13 Contact bridge
14 Moving contact piece

15 Moving contact piece
16 Contact compression spring
17 Extension
18 Contact point
19 Contact point
20 Fixed contact piece
21 Fixed contact piece
22 Actuator
23 Axis of rotation
24 First partial element
25 Second partial element
26 Accommodating opening
27 Pin
28 Contact carrier surface
29 Compression spring
31 Contact carrier as double-arm carrier
32 First arm
33 L-shaped extension
34 Second arm
35 L-shaped extension
36 Contact bridge
37 Contact bridge
38 Contact compression spring
39 Contact compression spring
40 Knife-edge bearing
41 Actuator
42 Actuator knife-edge bearing
43 Actuator
44 Axis of rotation
45 Roller
50 Contact carrier
51 Centre pivot shaft
52 Top side of contact carrier
53 Contact carrier
54 Roof-shaped projection
55 Peak

What is claimed is:

1. An electrical switching device, comprising:

at least one contact assembly in which, in a first position, the contact assembly is open and, in a second position, the contact assembly is closed so as to form a corresponding contact point, each contact assembly respectively comprising a corresponding moving first contact piece and a corresponding second contact piece which couple together to form the corresponding contact point;

a swivelling contact carrier on which each moving first contact piece of the at least one contact assembly is arranged, the contact carrier being configured to rotate about a first axis of rotation;

a compression contact spring arranged in the contact carrier and configured to act on the first moving contact piece of a corresponding one of the at least one contact assembly such that a contact force acting on the first moving contact piece of the corresponding one of the at least one contact assembly is established by the compression contact spring; and an actuator configured to drive the contact carrier, wherein the actuator comprises a swivel element, which is configured to rotate about a second axis of rotation, wherein said swivel element comprises a first partial element and a second partial element, wherein the second partial element includes a free end, wherein the first partial element and the second partial element are configured to be slid in mutually opposing directions and are configured to be pushed apart by a spring force, wherein the first partial element is rotatably mounted, and wherein the second partial element is configured to act together with the contact carrier at the free end of the second partial element.

2. The electrical switching device according to claim 1, comprising a spring inserted between the first partial element and the second partial element, wherein the spring is configured to apply the spring force and to guide the first partial element and the second partial element telescopically inside one another.

3. The electrical switching device according to claim 2, wherein the second axis of rotation of the actuator lies on a line, which in a dead point position runs perpendicular to a longitudinal extension of the contact carrier through the first axis of rotation, so that when the actuator is swivelled out of a first stable position via the dead point position in which the longitudinal extension of the actuator lies on the line, the actuator is moved into a second stable position and back again.

4. The electrical switching device according to claim 1, wherein the second axis of rotation of the actuator lies on a line, which in a dead point position runs perpendicular to a longitudinal extension of the contact carrier through the first axis of rotation, so that when the actuator is swivelled out of a first stable position via the dead point position in which the longitudinal extension of the actuator lies on the line, the actuator is moved into a second stable position and back again.

5. The electrical switching device according to claim 4, wherein the contact carrier is a single-arm rotary lever having a free end, and wherein each moving first contact piece is arranged on the free end of the single-arm rotary lever.

6. The electrical switching device according to claim 1, wherein the contact carrier is a single-arm rotary lever having a free end, and wherein each moving first contact piece is arranged on the free end of the single-arm rotary lever.

7. The electrical switching device according to claim 1, comprising at least two of the contact assemblies, wherein the contact carrier is a double-arm lever having a first free end and a second free end, wherein a corresponding one of the moving first contact piece of a first one of the at least two contact assemblies is arranged at the first free end of the contact carrier, and wherein a corresponding one of the moving first contact piece of a second one of the at least two contact assemblies is arranged at the second free end of the contact carrier.

8. The electrical switching device according to claim 7, wherein the at least one contact assembly comprises a contact bridge arranged on the contact carrier, wherein the moving first contact piece of the at least one contact assembly is mounted on the contact bridge, wherein at least one contact assembly comprises a moving third contact piece electrically connected to the moving first contact piece of the at least one contact assembly and mounted on the contact bridge, wherein the at least one contact assembly comprises a fourth contact piece, wherein the second and fourth contact pieces of the at least one contact assembly are fixedly arranged at a distance from one another, and wherein the third and fourth contact pieces of the at least one contact assembly are configured to form an additional contact point when the at least one contact assembly is closed.

9. The electrical switching device according to claim 1, wherein the at least one contact assembly comprises a contact bridge arranged on the contact carrier, wherein the moving first contact piece of the at least one contact assembly is mounted on the contact bridge, wherein at least one contact assembly comprises a moving third contact piece electrically connected to the moving first contact piece of the at least one contact assembly and mounted on the contact bridge, wherein the at least one contact assembly comprises a fourth contact piece, wherein the second and fourth contact pieces of the at least one contact assembly are fixedly arranged at a distance from one another, and wherein the third and fourth contact pieces of the at least one contact assembly are configured to form an additional contact point when the at least one contact assembly is closed.

10. The electrical switching device according to claim 9, wherein the at least one of the first axis of rotation and the second axis of rotation is formed by a corresponding pivot shaft.

11. The electrical switching device according to claim 9, wherein at least one of the first axis of rotation and the second axis of rotation are formed by a corresponding knife-edge bearing.

12. The electrical switching device according to claim 1, wherein the at least one of the first axis of rotation and the second axis of rotation is formed by a corresponding pivot shaft.

13. The electrical switching device according to claim 1, wherein at least one of the first axis of rotation and the second axis of rotation are formed by a corresponding knife-edge bearing.

14. The electrical switching device according to claim 1, wherein the free end of the actuator comprises a pin configured to slide on the contact carrier.

15. The electrical switching device according to claim 1, wherein the actuator comprises a roller configured to roll on the contact carrier, the roller being arranged at the free end of the actuator.

16. The electrical switching device according to claim 1, comprising a roof-shaped moulding arranged on a side of the contact carrier facing the actuator, the roof-shaped moulding having a peak lying on a line connecting the first axis of rotation of the contact carrier and the second axis of rotation of the actuator.

17. The electrical switching device according to claim 1, wherein the contact carrier is comprised of electrically insulating material.

18. The electrical switching device according to claim 17, wherein the contact carrier comprises a metal plate configured as a knife-edge bearing, which forms the first axis of rotation of the contact carrier.

19. The electrical switching device according claim 1, wherein the contact carrier comprises a reinforcing plate, and wherein the free end of the actuator is configured to at least one of slide and roll over the reinforcing plate.

20. The electrical switching device according to claim 19, comprising at least two of the contact assemblies, wherein the contact carrier is a double-arm lever having a first free end and a second free end, wherein a corresponding one of the moving first contact piece of a first one of the at least two contact assemblies is arranged at the first free end of the contact carrier, and wherein a corresponding one of the moving first contact piece of a second one of the at least two contact assemblies is arranged at the second free end of the contact carrier.

21. The electrical switching device according to claim 1, wherein the electrical switching device is a thermal relay.

22. The electrical switching device according to claim 1, wherein the contact carrier comprises a first portion and a projection extending at an angle from the first portion, and wherein the contact compression spring is arranged on the projection.

23. The electrical switching device according to claim 22, wherein the angle is 90 degrees.

24. The electrical switching device according to claim 1, wherein the first partial element is rotatably mounted about the second axis of rotation.

* * * * *